United States Patent [19]

Andreasson

[11] 4,452,199

[45] Jun. 5, 1984

[54] NON-CONTACT IGNITION SYSTEM

[75] Inventor: Bo C. Andreasson, Gothenburg, Sweden

[73] Assignee: EMAB Electrolux Motor Aktiebolag, Huskvarna, Sweden

[21] Appl. No.: 540,345

[22] Filed: Oct. 11, 1983

[30] Foreign Application Priority Data

Oct. 13, 1982 [SE] Sweden ..... 8205820

[51] Int. Cl.[3] ..... F02P 5/04; F02P 1/00

[52] U.S. Cl. ..... 123/335; 123/149 R; 123/149 A; 123/602

[58] Field of Search ..... 123/149 R, 149 A, 335, 123/602, 644, 418

[56] References Cited

U.S. PATENT DOCUMENTS

| | | | |
|---|---|---|---|
| 4,144,859 | 3/1979 | Ohki | 123/335 |
| 4,188,929 | 2/1980 | Podrapsky | 123/602 |
| 4,204,490 | 5/1980 | Ohki | 123/335 |
| 4,343,273 | 8/1982 | Kondo | 123/335 |
| 4,344,395 | 8/1982 | Kondo | 123/335 |
| 4,404,940 | 9/1983 | Seija | 123/335 |

*Primary Examiner*—Ronald B. Cox

*Attorney, Agent, or Firm*—Alfred E. Miller

[57] ABSTRACT

An ignition circuit according to the present invention has the properties of trigging, i.e. releasing the spark at a predetermined point behind the top of the primary voltage (the ignition generator voltage). During the ascending primary voltage the ignition switch (12) is conducting while a capacitor voltage ($U_K$) is developed. When the primary voltage has passed its top value a potential difference to the capacitor voltage ($U_K$) is created, which is used for the control of the switch to make it break. By the interruption of the primary current an ignition voltage is induced at duty r.p.m. in an ignition coil (11). At an extremely high r.p.m. the ignition is delayed behind the voltage top whereby the induced voltage will be too low for ignition. Too high an r.p.m. is thereby avoided.

8 Claims, 4 Drawing Figures

NON-CONTACT IGNITION SYSTEM

This invention relates to a non-contact ignition system for i.c. engines with an ignition generator generating a primary voltage in the form of pulses.

It is priorly known in the art of ignition circuits to provide a special trigging circuit for releasing the spark energy with a predetermined advance before the top dead position of the piston. Such a circuit can be constituted by a coil which is closely passed by the permanent magnet positioned in the flywheel of the engine and included in the ignition generator, whereby a trig pulse is generated in the coil when the magnet passes by. In lately developed ignition circuis the trigging coil has been excluded and replaced by a control circuit which generates the trig pulse by means of the ignition energy pulse generated in the generator. One point of that pulse is chosen as reference point and a detector senses this point and releases a trig pulse. By means of this detector and the control circuits associated therewith it is possible to introduce useful functions in the ignition of the engine, for instance advance ignition control and r.p.m. limit control.

The object of the present invention is to create an electronic overspeed prevention in an ignition generator of the above type. Such a prevention is used in engines which are subject to a very varying load, e.g. power chain saws. Occasions on which the r.p.m. must be limited may occur both in duty and on start of the engine. The invention can also be applied to engines having a continuous load, the purpose of the invention appearing in keeping the r.p.m. of the engine constant. These properties of an ignition system appear when it is composed in accordance with the characteristics of claim 1.

Figure 3:
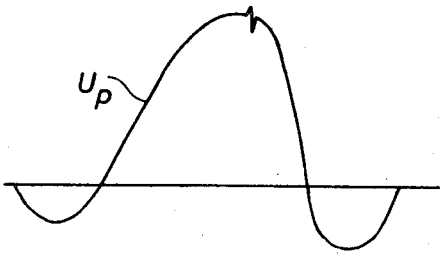
Figure 4:
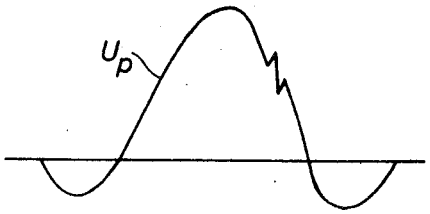

An embodiment of the invention will be described in the following with reference to the accompanying drawing showing in FIG. 1 a wiring diagram of the ignition system, FIG. 2 voltage curves in the wiring, FIG. 3 a voltage showing an ignition point, and FIG. 4 another curve of this kind.

Figure 1:
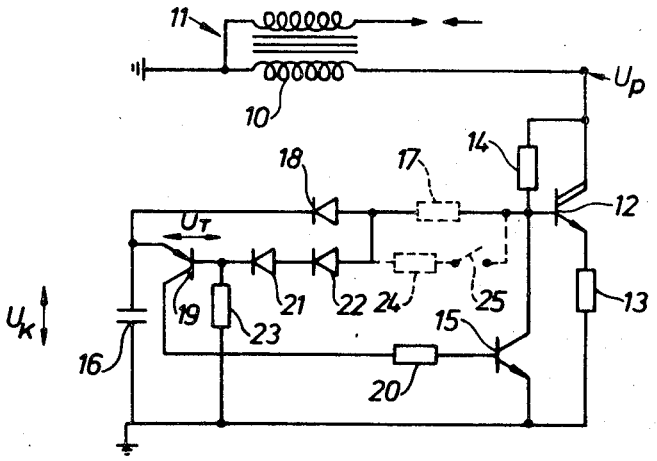

The diagram of FIG. 1 shows an example of an electronic wiring of the ignition system. An ignition energy circuit is formed by a primary winding 10, an ignition coil 11, a Darlington transistor 12 and a current limiting resistor 13. The transistor has a control circuit formed by a resistor 14 and an NPN-transistor 15. In the connection to the base of the transistor 12 an RC-circuit is connected composed by a capacitor 16 and a resistor 17 joined through a diode 18. The voltage $U_K$ of the capacitor passes via a PNP-transistor 19 and a resistor 20 to the base of the NPN-transistor. The PNP-transistor has a control circuit composed by diodes 21, 22 and a resistor 23 to earth.

Figure 2:
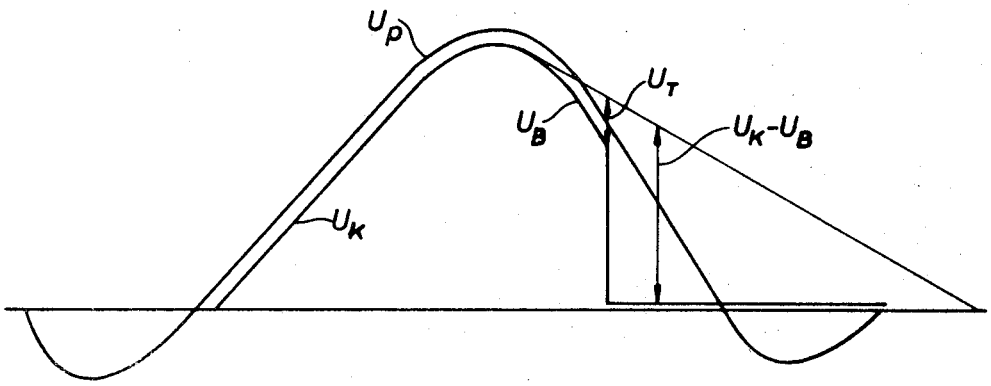

The primary winding supplies a voltage $U_P$ induced by the magnet in the flywheel according to FIG. 2. In the said ignition energy circuit current passes as soon as the voltage of the primary winding is positive. During the positive part of the voltage the capacitor is charged in accordance with the curve $U_K$ and a voltage $U_B$ of the base of the PNP-transistor follows approximately in parallel up to the top of the curve. After the top there will be a difference $U_K-U_B$ so that the threshold $U_T$ of the transistor 19 is exceeded and this transistor starts conducting. The NPN-transistor then has a control current and starts conducting bringing about a decrease of the base voltage of the Darlington transistor. The latter, hitherto conducting on the ascending of the voltage curve $U_P$, is thereby controlled to break so that the primary current in the ignition coil falls to zero and an ignition voltage is induced in the secondary winding. This is the procedure on driving the engine at a moderate r.p.m. (FIG. 3).

However, it is possible to provide another resistance in the wiring and this is shown in FIG. 1 by dashed lines. This resistance, which is here formed by two resistors 17, 24 in parallel, is in series with the previously mentioned RC-circuit and acts as a delay of the release of the ignition voltage. The voltage $U_K$ will not rise to the same level as in the procedure described above and thus $U_P$ must fall a longer distance from the top to make the voltage $U_K-U_B$ exceed the threshold $U_T$ of the transistor 19. The factor RC is the time constant determining the charge of the capacitor and the shorter the charging time the less the voltage $U_K$. When the r.p.m. exceeds a predetermined value n the charging time will be so short that the difference $U_K-U_B$=the threshold will occur far down on the curve $U_P$(FIG. 4). The primary voltage is then so low that the ignition voltage induced on the break in the Darlington transistor will be so low that the spark fails to come. As there is no ignition in the engine its r.p.m. will fall below the value n at which the ignition is managed again. In practice there shall be a balance between ignition/non-ignition so that the r.p.m. stays slightly below n.

By a special wiring including a switch 25 in series with the resistor 24 the value of the resistance can be changed and thus also the value of n. As mentioned in the introduction, r.p.m. limitation may be needed in duty as well as on start. One value of n can be determined for duty and another for start. As an example of the first value n may be approximately 10000 and of the second value n can be approximately 3000 r.p.m.

The described embodiment shall be considered as an example of a wiring having the properties obtained by the invention. Modifications of the system can be made without deviating from the scope of the invention as defined in the claims.

I claim:

1. Non-contact, overspeed preventing ignition system for an i.c. engine including an ignition coil (11) with primary and secondary windings and a movable magnet generating a primary voltage in the form of pulses, in which the primary winding (10) is in series with an ignition switch (12) with a control circuit which, during an ascending part of the curve of such a voltage pulse, keeps the switch conducting simultaneously as a capacitor (16) in an RC-circuit is charged, which RC-circuit is connected to the control electrode of the switch and which capacitor is connected in parallel to a transistor circuit so that the voltage difference ($U_K-U_B$) between the voltage ($U_K$) of the capacitor and the control voltage ($U_B$) of the transistor circuit, after said ascending part of the curve exceeds a critical ignition voltage ($U_T$) in this circuit and the capacitor is discharged whereby the control voltage in the control circuit ceases and the ignition swtich (12) breaks the pulse in the primary winding, characterized in that the said RC-circuit has a time constant for reaching the said critical ignition voltage ($U_K-U_B=U_T$) at an r.p.m. of the engine higher than 10000 r.p.m. on a descending part of the curve of the voltage pulse which on the breaking of the primary circuit induces a secondary voltage in the ignition coil which is insufficient for ignition.

2. Non-contact ignition system according to claim 1, characterized in that in the RC-circuit a rectifier (18) is connected in series with the resistance (17,24) of the RC-circuit and with the capacitor (16) and that the critical ignition voltage ($U_T$) in the transistor circuit appears on the said rectifier.

3. Non-contact ignition system according to claim 2, characterized in that the said resistance (17,24) is connected in series with a base-emitter resistor (14) which connects the base and emitter electrodes of the ignition switch (12).

4. Non-contact ignition system according to claim 2, characterized in that the said resistance (17,24) is composed by two parallel resistors, of which one (24) is in series with a switch (25) and that by opening this switch the resistance and capacitance of the RC-circuit make a time constant for reaching the critical ignition voltage ($U_T$) at an r.p.m. of the engine higher than 3000 r.p.m. on the descending part of the curve of the voltage pulse which on said breaking of the primary circuit induces a secondary voltage which is insufficient for ignition.

5. Non-contact ignition system according to claim 2, characterized in that a transistor (15) is connected between the control electrode of the ignition switch and earth and keeps conductivity (thyristor) as long as current passes through it, whereby the break by the switch is maintained until the proceeding primary voltage becomes zero.

6. In an ignition system, for an internal combustion engine, having an ignition coil, means inducing pulses in said coil as the engine rotates, ignition switch means connected to enable current flow in said coil, and control means connected to control said switch means to interrupt said current flow; the improvement wherein said control means comprises a capacitor, resistor and diode means connected to charge said capacitor from said pulses whereby said capacitor is charged in the ascending portions of said pulses, transistor means, means applying a voltage corresponding to the difference between the voltage of said capacitor and the voltage of said pulses, as a control voltage, to said transistor means, during the descending portions of said pulses, whereby said transistor means is rendered conductive at a time after the peak of each of said pulses, said transistor means being connected to control said switch means, said capacitor and resistor means defining and RC-circuit having a time constant that advances the timing of ignition resulting from interruption of said switch means in a determined range of r.p.m. of said engine, said time constant having a value to inhibit sufficient charging of said capacitor, at a determined higher r.p.m., to inhibit interruption of said switch means at said higher r.p.m., thereby inhibiting overspeed operation of said engine.

7. The ignition system of claim 6 wherein said transistor means comprises a transistor having its emitter connected to said capacitor and its base connected by way of further diode means to a junction of said first mentioned diode means and resistor means, whereby the base voltage of said transistor follows the instantaneous voltage of said pulses.

8. The ignition system of claim 7 wherein said switch means comprises resistor means.

* * * * *